US006505782B1

(12) United States Patent
Yen

(10) Patent No.: US 6,505,782 B1
(45) Date of Patent: Jan. 14, 2003

(54) AQUAVISION FOUNTAINS POT

(76) Inventor: Jen-Yen Yen, No. 22-1, Lane 3, Haochin Rd., Nanhsin Tsun, Yenpu Hsiang, Changhua County (TW)

( * ) Notice: Subject to any disclaimer, the term of this patent is extended or adjusted under 35 U.S.C. 154(b) by 0 days.

(21) Appl. No.: 10/005,106

(22) Filed: Dec. 7, 2001

(51) Int. Cl.[7] ..... B05B 17/08
(52) U.S. Cl. ..... 239/17; 239/211
(58) Field of Search ..... 239/16, 17, 20, 239/21, 23, 211; D23/201, 288; 47/41.01, 41.14, 59

(56) References Cited

U.S. PATENT DOCUMENTS

D213,692 S * 4/1969 Hibben ..... 239/17
3,820,715 A * 6/1974 Hamilton ..... 239/17
5,127,366 A * 7/1992 Kim ..... 119/246
6,149,070 A * 11/2000 Hones ..... 239/16
6,209,797 B1 * 4/2001 Jenney ..... 239/17

* cited by examiner

*Primary Examiner*—Lisa A. Douglas
(74) *Attorney, Agent, or Firm*—Rosenberg, Klein & Lee

(57) ABSTRACT

An aquavision fountain pot is constructed to include a pot body holding an amount of water, a face panel mounted in the pot body, the face panel having separated waterways and top jet nozzles respectively disposed in communication with the waterways, a plurality of motor pumps installed in a watertight chamber defined in the pot body and controlled by a function controller to pump water from the pot body to the waterways and the jet nozzles to show a water dance, and dashboards provided around the jet nozzles to buffer fallen water.

5 Claims, 7 Drawing Sheets

AQUAVISION FOUNTAINS POT

BACKGROUND OF THE INVENTION

1. Field of the Invention

The present invention relates to an aquarium motion indoor decorative item and, more specifically, to an aquavision fountains pot, which produces music and, ejects jets of water to show a water dance subject to the rhythms of the music.

2. Description of the Related Art

Various aquarium motion indoor decorative items are commercially available. These aquarium motion indoor decorative items commonly use a water pump to pump water from a water chamber at a low place to a water outlet at a high place, enabling outputted water to fall to the water chamber. This watering action is monotonous.

SUMMARY OF THE INVENTION

The present invention has been accomplished under the circumstances in view. It is one object of the present invention to provide an aquavision fountains pot, which shows a water dance subject to the rhythms of a music outputted through a speaker installed therein. It is another object of the present invention to provide an aquavision fountains pot, which is compact and portable. It is still another object of the present invention to provide an aquavision fountains pot, which prevents fallen water from splashing over the surroundings. According to one aspect of the present invention, the aquavision fountains pot comprises a pot body holding an amount of water, a face panel mounted in the pot body, the face panel having separated waterways and top jet nozzles respectively disposed in communication with the waterways, and a plurality of motor pumps installed in a watertight chamber defined in the pot body and separately controlled by a function controller to pump water from the pot body to the waterways and the jet nozzles to show a water dance. According to another aspect of the present invention, dashboards are provided around the jet nozzles to buffer fallen water.

DETAILED DESCRIPTION OF THE PREFERRED EMBODIMENT

Figure 1:
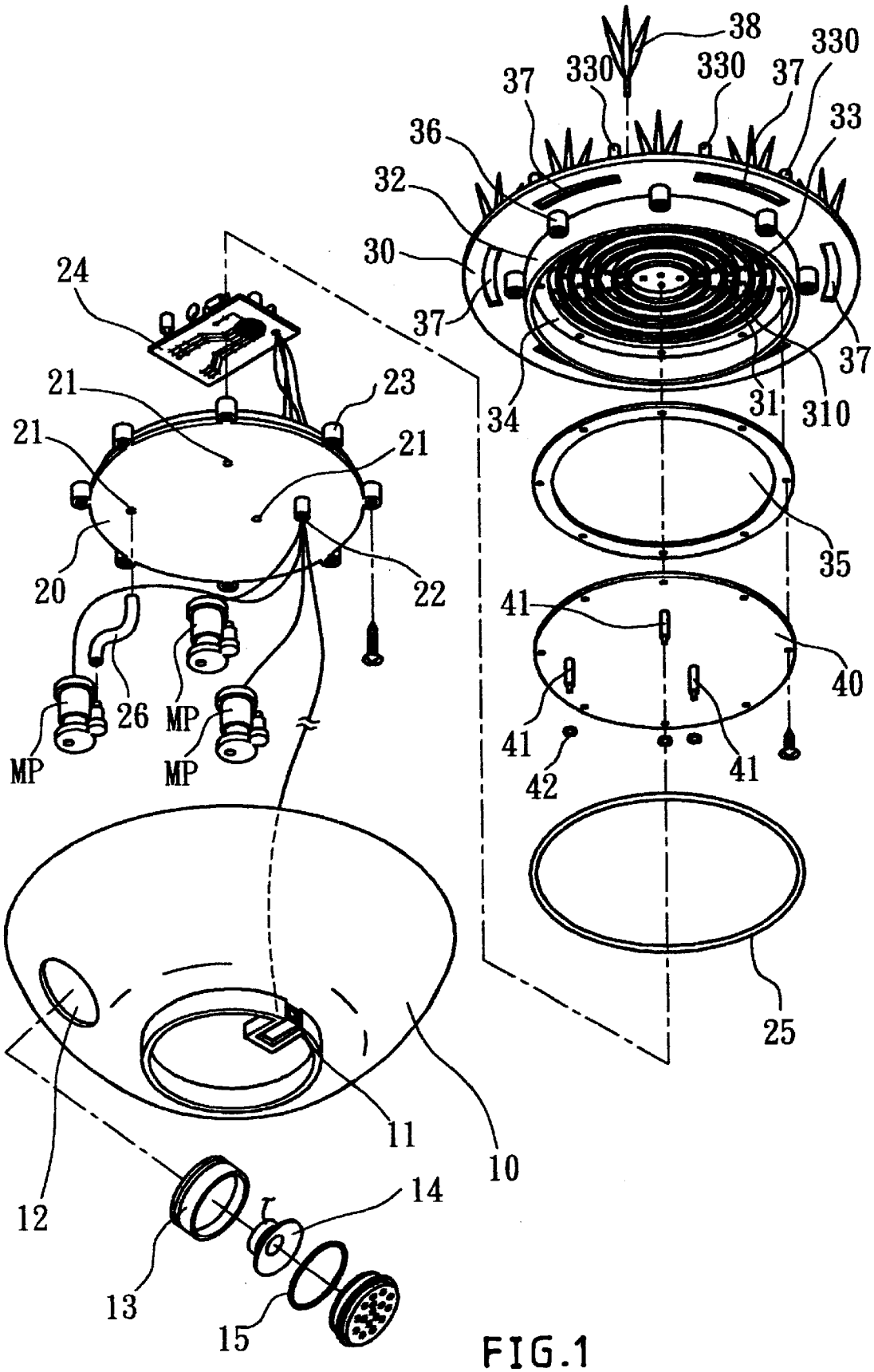
FIG. 1 is an exploded view of an aquavision fountains pot constructed according to the present invention.

Referring to FIGS. from 1 through 3, an aquavision fountains pot in accordance with the present invention is generally comprised of a pot body 10, a face panel 30, an upper seal plate 40, a bottom sealing plate 20, a function controller 24, and a plurality of motor pumps MP.

The pot body 10 comprises a bottom wire hole 11, which is sealed with a sealing glue H after insertion of a power cord, and a side through hole 12, which is mounted with a speaker holder 13 and a seal ring 15 to support a speaker 14.

The face panel 30 comprises an annular flange 32 downwardly protruded from the bottom sidewall thereof, an annular step 34 protruded from the bottom sidewall within the annular flange 32, a plurality of annular ribs 31 of different diameters provided at the bottom sidewall and concentrically disposed within the annular step 34, a plurality of annular waterways 310 respectively defined in between the annular ribs 31, a plurality of jet holes 33 cut through the bottom sidewall in communication with the annular waterways 310 respectively, a plurality of jet nozzles 330 respectively upwardly extended from the top sidewall thereof and connected to the jet holes 33 to receive water from the jet holes 33, a plurality water return holes 37 disposed around the periphery outside the annular flange 32, a plurality of dashboards 38 respectively disposed around the jet nozzles 330 and adapted for buffering fallen water, and a plurality of female screws 36 for mounting.

The upper sealing plate 40 is fixedly fastened to the annular step 34 within the annular flange 32 of the face panel 30 to seal the waterways 310. Further, a gasket ring 35 is sandwiched in between the upper sealing plate 40 and the annular step 34 to seal the gap. The upper sealing plate 40 comprises a plurality of bottom tubes 41 mounted with respective rubber rings 42 and respectively connected to the motor pumps MP through respective hoses 26 and adapted for guiding forced water to the waterways 310.

The bottom sealing plate 20 is covered on the annular flange 32 of the face panel 30 and sealed with a gasket ring 25, comprising a plurality of a plurality of female screws 23 respectively connected to the female screws 36 of the face panel 30 by screws, a plurality of through holes 21, which receive the bottom tubes 41 and the rubber rings 42, and a wire hole 22 through which the power cord of the function controller 24 extends to the outside. After insertion of the power cord of the function controller 24 through the wire hole 22, the wire hole 22 is sealed with a sealing glue H. The bottom sealing plate 20, the annular flange 32 of the face panel 30, and the upper sealing plate 40 define a watertight chamber W in which the function controller 24 is installed.

The motor pumps MP are respectively mounted in the pot body 10 below the bottom sealing plate 20 and respectively connected to the hoses 26.

The function controller 24 controls the pumping operation of the motor pumps MP, and has a music IC (not shown) adapted for output music through the speaker 14.

Figure 2:
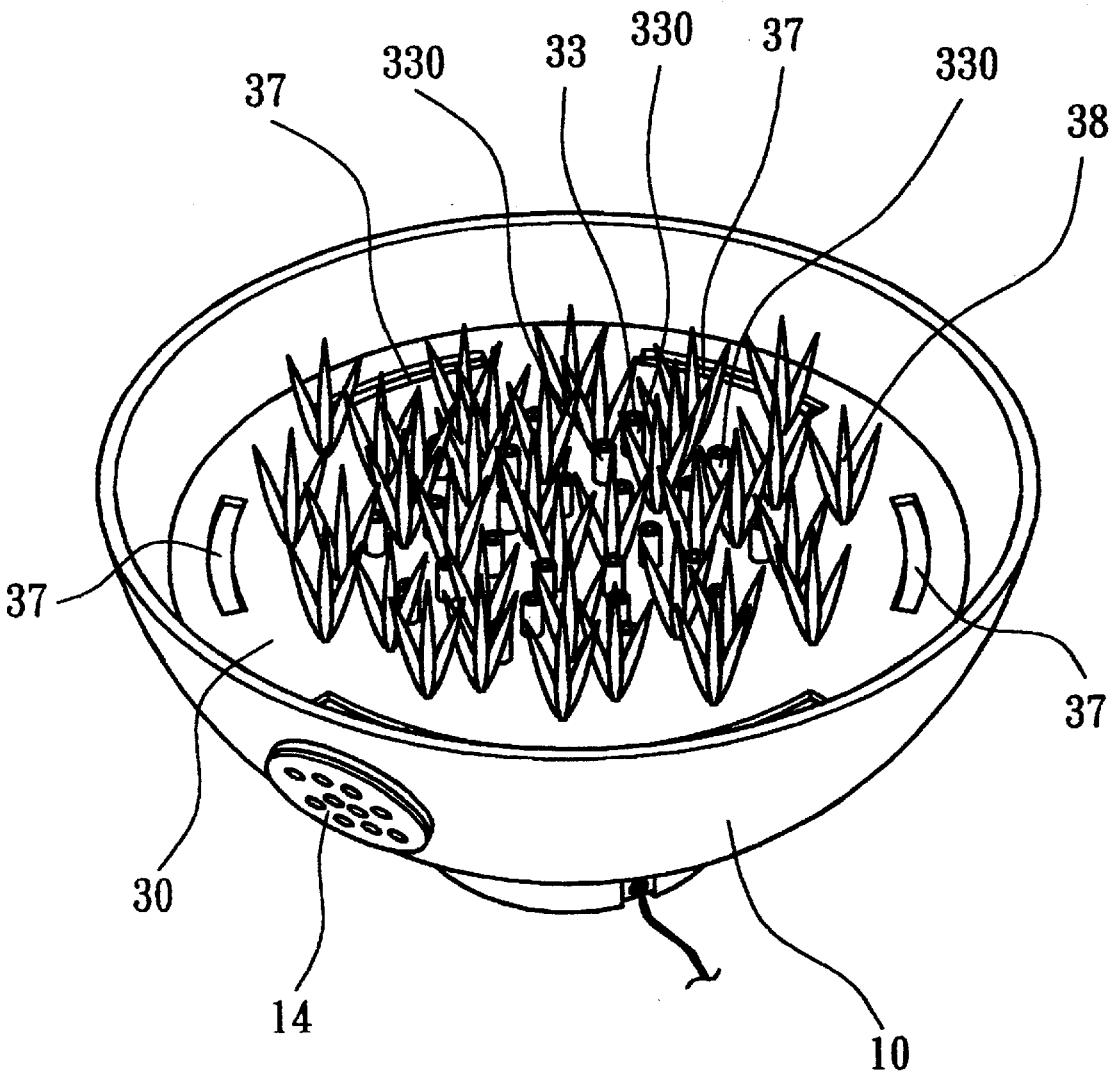
FIG. 2 is an elevational view of the aquavision fountains pot according to the present invention.
Figure 3:
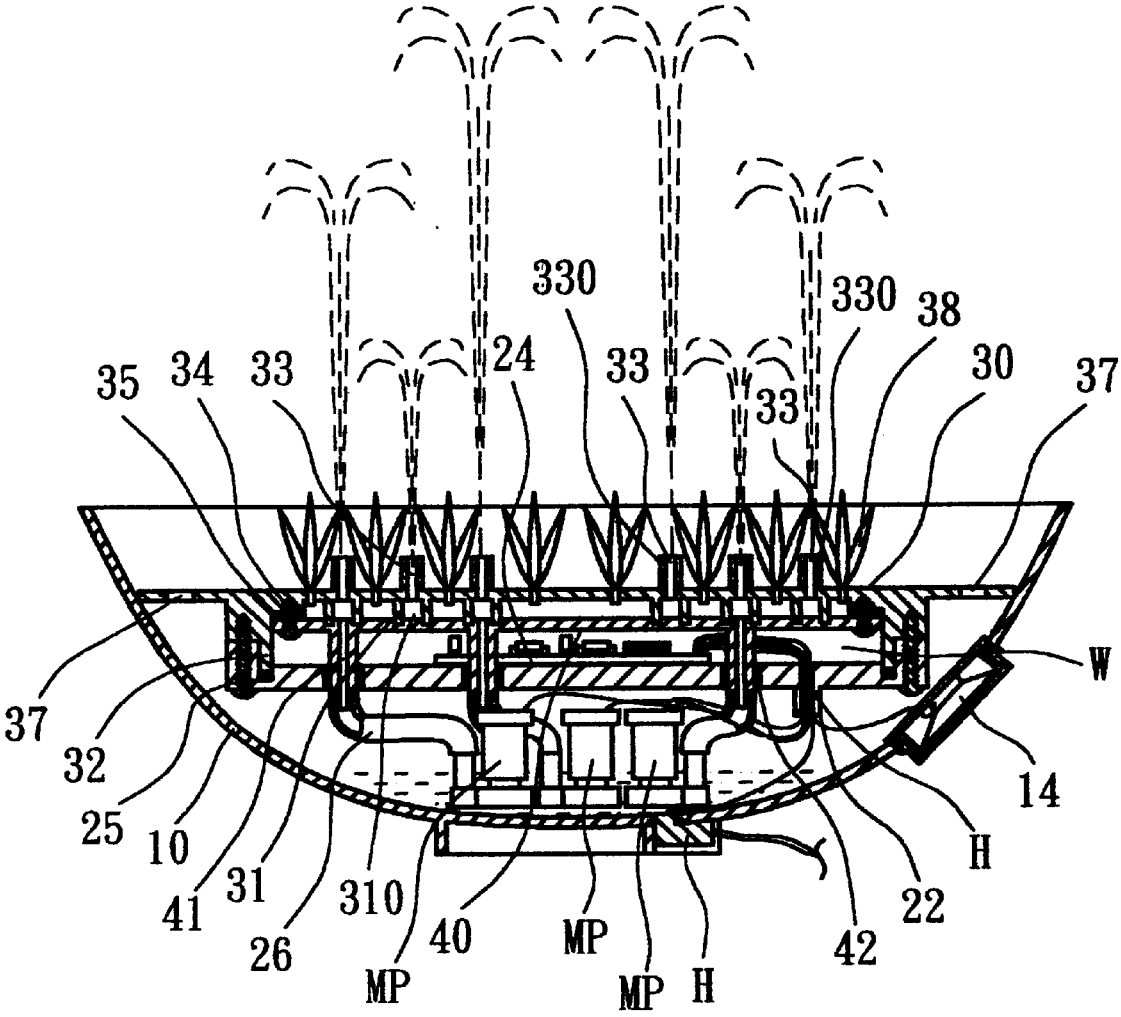
FIG. 3 is a sectional view of the present invention showing jets of water driven out of the jet holes.

Referring to FIGS. 2 and 3 again, when started the motor pumps MP, the motor pumps MP pumps accumulated water from the pot body 10 into the hoses 26, thereby causing forced water to be forced out of the jet nozzles 330 through the jet holes 33 to show a water dance. Fallen water is buffered by the dashboards 38, and then returned to the inside of the pot body 10 through the return holes 37 for further circulation.

As stated above, the invention achieves the following functions and advantages:

1. The function controller 24 controls the operation of the motor pumps MP following the rhythms of the music outputted through the speaker 14, showing an aquavision of water dance.
2. Because the function controller 24 is mounted in the watertight chamber W surrounded by the bottom sealing plate 20, the annular flange 32 of the face panel 30, and the upper sealing plate 40, it is well protected against water.

Figure 4:
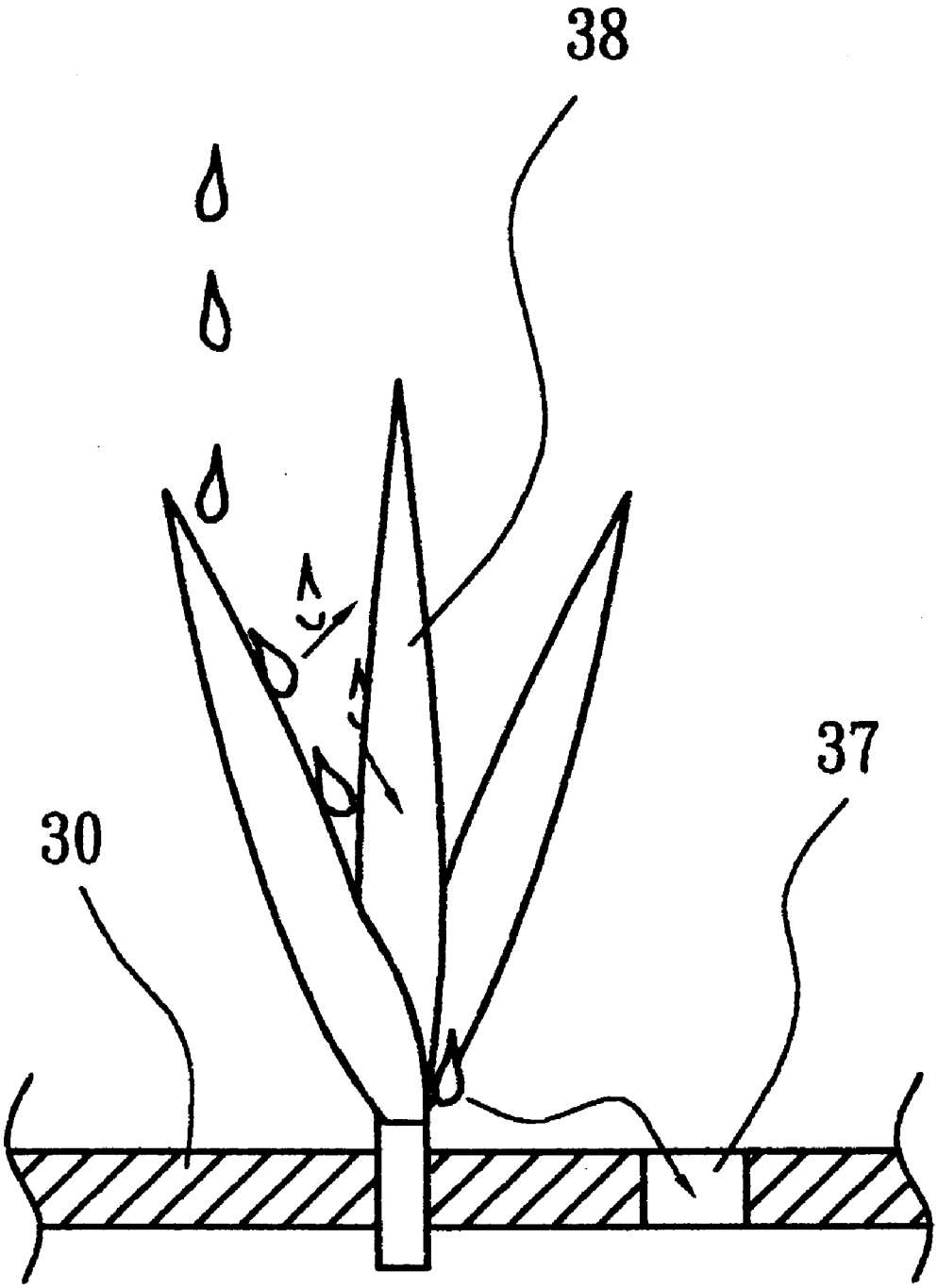
FIG. 4 is a schematic drawing of a part of the present invention showing fallen water dropped to the dashboards.

3. The upper sealing plate 40 seals the waterways 310, enabling water to be separately pumped out of the jet nozzles 330 through the jet holes 33 to produce different jets of water, performing an aquavision.
4. The dashboards 38 buffer fallen water (see FIG. 4), enabling fallen water to be smoothly guided to the return holes 37.
5. The whole assembly of the aquavision fountains pot is compact and portable, and the user can place the aquavision fountains pot on any desired place.

Figure 5:
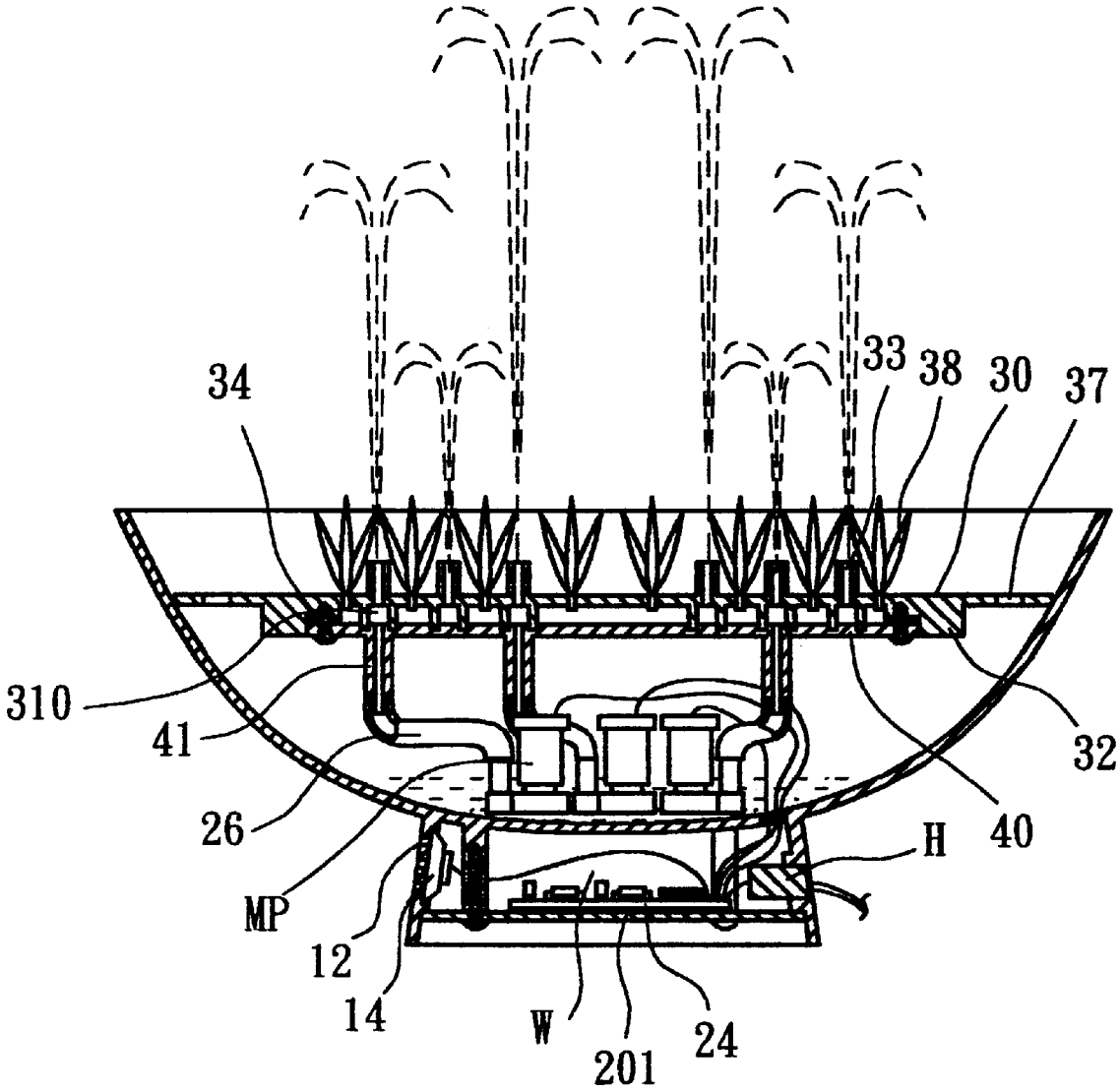
FIG. 5 is a sectional view of an alternate form of the aquavision fountains pot according to the present invention.

FIG. 5 shows an alternate form of the present invention. According to this alternate form, the pot body 10 has a hollow base 201 defining an airtight chamber W adapted for holding the function controller 24 and the speaker 14. The watertight chamber W can be made having a bottom open side, which is sealed after installation of the function controller 24 and the speaker 14.

Figure 6:
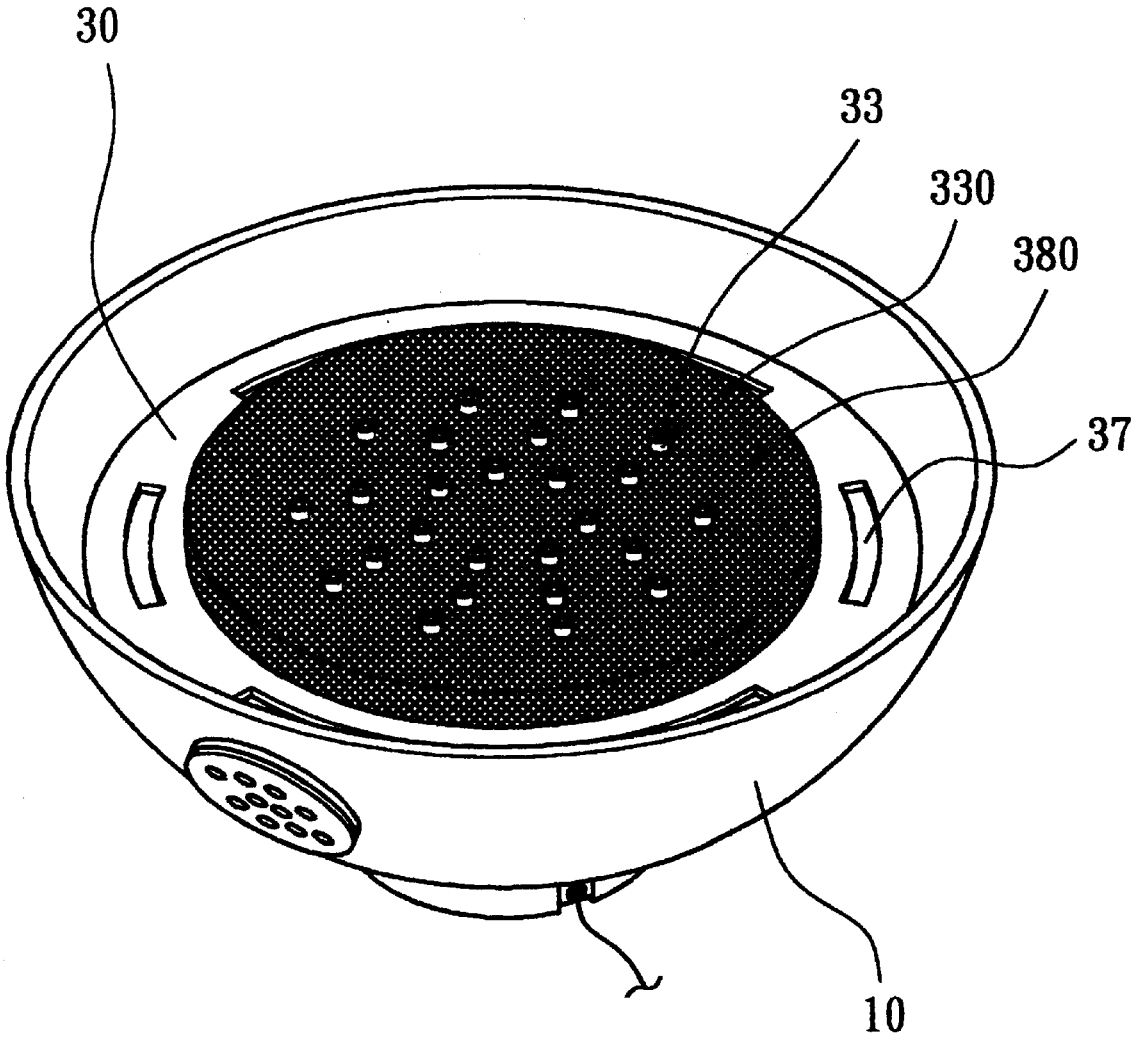
FIG. 6 is an elevational view of another alternate form of the aquavision fountains pot according to the present invention.

FIG. 6 shows another alternate form of the present invention. According to this embodiment, a sponge 380 is covered on the top sidewall of the face panel 30 to buffer and absorb fallen water.

Figure 7:
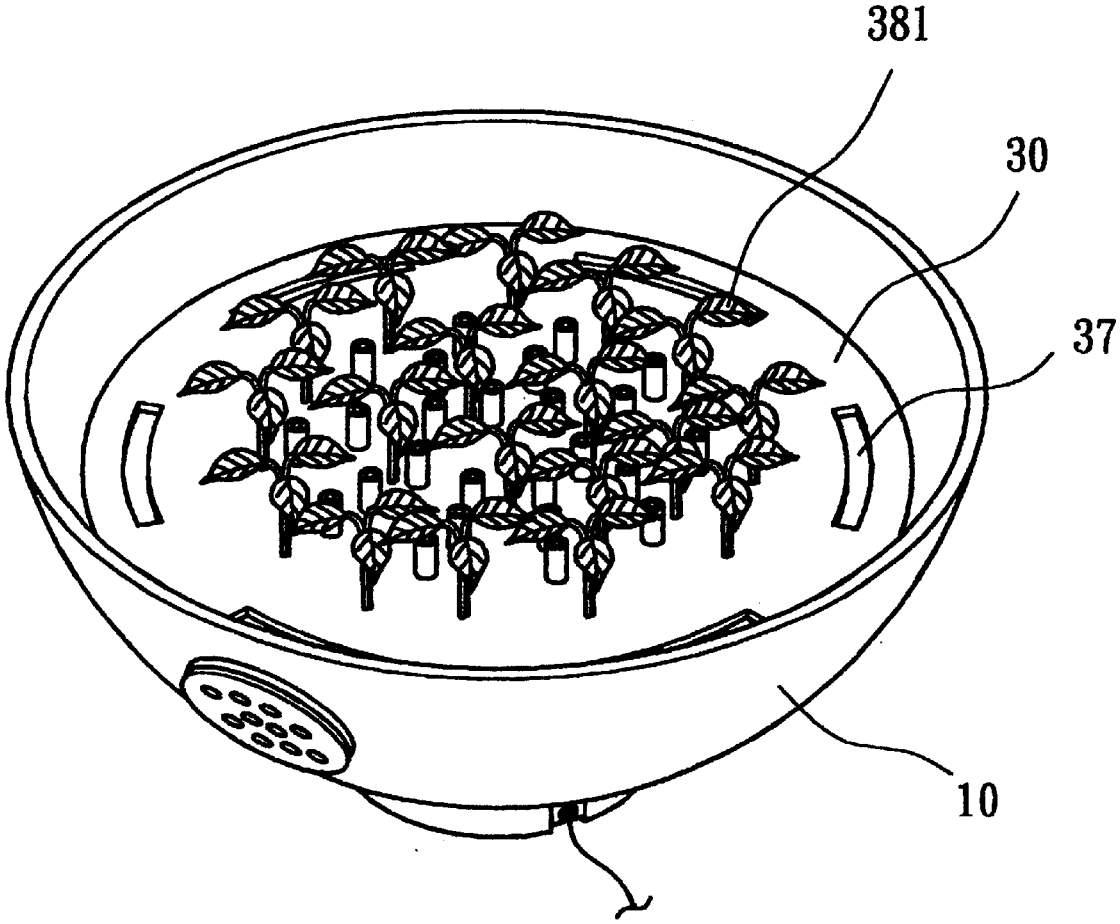
FIG. 7 is an elevational view of still another alternate form of the aquavision fountains pot according to the present invention.

FIG. 7 shows still another alternate form of the present invention. According to this embodiment, the dashboards 381 are made of flexible material and shaped like the leaves of a plant.

A prototype of aquavision fountains pot has been constructed with the features of the annexed drawings of FIGS. 1~7. The aquavision fountains pot functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An aquavision fountain pot comprising:

a pot body holding an amount of water, said pot body comprising a watertight chamber;

a face panel mounted in said pot body, said face panel comprising a plurality of jet nozzles for output of water from said pot body, a plurality of return holes for guiding outputted water back to said pot body, a plurality of waterways defined in a bottom sidewall thereof and sealed from one another by water sealing means;

a plurality of motor pumps installed in said watertight chamber and adapted for pumping water from said pot body to said waterways and said jet nozzles respectively;

a function controller installed in said watertight chamber and adapted for controlling the operation of said motor pumps; and a plurality of dashboards respectively disposed around said jet nozzles and adapted for buffering fallen water and guiding fallen water to said return holes.

2. The aquavision fountain pot as claimed in claim 1, wherein said face panel comprises an annular flange protruded from the bottom sidewall outside said waterways, and sealing plates fixedly sealed to said annular flange and defining with said annular flange said watertight chamber for holding said function controller and said motor pumps.

3. The aquavision fountains pot as claimed in claim 1, wherein said dashboards are made of sponge.

4. The aquavision fountains pot as claimed in claim 1, wherein said dashboards are made of flexible material and shaped like the leaves of a plant.

5. The aquavision fountains pot as claimed in claim 1, wherein said face panel comprises an annular step protruded from the bottom sidewall, a plurality of annular ribs of different diameters concentrically provided at the bottom sidewall within said annular step and defining said waterways, and a sealing plate fixedly fastened to said annular step and sealed with a gasket ring to separate said waterways from one another, said sealing plate having a plurality of connecting tubes respectively disposed in communication with said waterways and respectively connected to said motor pumps by a respective hose.

* * * * *